US006737808B1

(12) United States Patent
Hendricx et al.

(10) Patent No.: US 6,737,808 B1
(45) Date of Patent: May 18, 2004

(54) METAL HALIDE LAMP

(75) Inventors: Josephus Christian Maria Hendricx, Eindhoven (NL); Nancy Jean Caruso, Turnout (BE); Kurt Jan Augusta Peelaers, Turnhout (BE); Veronique Emeralda Duivelshof, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 335 days.

(21) Appl. No.: 09/645,059

(22) Filed: Aug. 24, 2000

(30) Foreign Application Priority Data

Aug. 25, 1999 (EP) ..... 99202749

(51) Int. Cl.[7] ..... H01J 17/20; H01J 17/00
(52) U.S. Cl. ..... 313/639; 313/637; 313/638
(58) Field of Search ..... 313/637, 638, 313/639, 640, 641, 634, 573, 571, 620, 621, 25

(56) References Cited

U.S. PATENT DOCUMENTS 5,334,906 A * 8/1994 Muzeroll ..... 313/25
5,363,007 A * 11/1994 Fromm et al. ..... 313/25
6,031,332 A * 2/2000 Wijenberg et al. ..... 313/637

FOREIGN PATENT DOCUMENTS

| | | | |
|---|---|---|---|
| EP | 0 215 524 | * 3/1987 | ..... H01J/61/30 |
| EP | 0807959 | 11/1997 | ..... H01J/61/82 |
| WO | 9845872 | 10/1998 | ..... H01J/61/18 |

* cited by examiner

*Primary Examiner*—Nimeshkumar D. Patel

*Assistant Examiner*—Karabi Guharay

(57) ABSTRACT

The invention relates to a metal halide lamp having a nominal power of more than 100 W, comprising a discharge vessel with a ceramic wall. The discharge vessel encloses a discharge space having an ionizable filling which, in addition to Hg, contains a quantity of iodide of Na, Tl, Ho and Ca. Two electrodes each having an electrode tip at a mutual distance EA are arranged inside the discharge vessel. The discharge vessel has a cylindrical part with an internal diameter ID and extends through at least the distance EA. According to the invention, the relation EA/ID<1 is satisfied.

10 Claims, 1 Drawing Sheet

METAL HALIDE LAMP

BACKGROUND OF THE INVENTION

The invention relates to a metal halide lamp having a nominal power of more than 100 W, comprising a discharge vessel with a ceramic wall enclosing a discharge space containing an ionizable filling which, in addition to Hg, comprises a quantity of iodide of Na, Tl, Ho and Ca, and in which two electrodes are arranged, each with their electrode tip located at a mutual distance EA, said discharge vessel comprising a cylindrical part having an internal diameter ID and extending at least through the distance EA.

A lamp of the type described in the opening paragraph is known from WO 98/45872 (N16313). The known lamp has a high specific luminous flux and, in operation, emits light at a high color temperature $T_c$ and a value of at least 90 for the general color rendering index $R_a$.

In this lamp, use is made of the recognition that a satisfactory color rendition is possible when Na halide is used as a filling constituent of a lamp and when, during operation, there is a strong widening and reversal of the Na emission in the Na-D lines. This requires a high temperature of the coldest spot $T_{kp}$ in the discharge vessel of, for example, 1170 K (900° C.). When reversing and widening the Na-D lines, these assume the shape of an emission band in the spectrum, with two maxima at a mutual distance $\Delta\lambda$.

The requirement for a high value of $T_{kp}$ excludes the use of quartz or quartz glass for the wall of the discharge vessel and necessitates the use of ceramic material for this wall.

In this description and the claims, a ceramic wall is understood to mean both a wall of metal oxide such as, for example, sapphire or densely sintered polycrystalline $Al_2O_3$, and metal nitride, for example, AlN.

Although the known lamp has good color properties and a relatively high luminous flux, the lamp has relatively large dimensions. Concentration of the light to a beam emitted by the lamp, for example, by means of a lens or a diaphragm for projection purposes thus results in a relatively large loss of light. This is a drawback.

SUMMARY OF THE INVENTION

It is an object of the invention to provide a lamp of the type described in the opening paragraph, in which the drawback is obviated to a considerable extent.

According to the invention, this object is achieved in that the lamp of the type described in the opening paragraph is characterized in that the relation EA/ID<1 is satisfied An advantage of the lamp according to the invention is that the light emitted by the lamp can be better concentrated to a beam, while, surprisingly, it is also possible that the luminous flux and the color temperature $T_c$ decrease in value only to a small extent while maintaining the value for the general color rendering index $R_a$. The lamp according to the invention is suitable, inter alia, as a light source for coupling light into a light-conducting fiber. A decrease of the ratio EA/ID below 0.65 generally leads, in the case of a constant ID, to an unacceptably low specific luminous flux of the lamp. An improvement of the lamp according to the invention is possible when the lamp has a wall load of at least 110 W/cm$^2$. Wall load is herein understood to mean the quotient of the lamp power and the inner surface of that part of the discharge vessel which extends through the distance EA. It is thereby achieved that, in the case of coupling light into an optical fiber, a better coupling efficiency can be realized, which leads to a higher system efficiency.

In a further variant, the ionizable filling also comprises iodide of Dy and Tm. A lamp with a color temperature $T_c \geqq 4{,}000$ K is then possible.

The lamp is preferably provided with an outer envelope enclosing the discharge vessel with a space. The space is preferably filled with an inert gas, for example $N_2$. The gas in the space has a cooling effect on the wall of the discharge vessel. In the operating state of the lamp, the pressure of the inert gas is at least 100 Mbar and preferably not more than 1 bar in order that risk of explosion is excluded There is preferably a minimum distance of 3 mm between the outer envelope and the wall of the discharge vessel. At distances of less than 3 mm between the outer envelope and the wall of the discharge vessel, it appears that the wall of the discharge vessel is cooled less effectively. A reduction of the distance below the minimum distance is a drawback in practice because of the positioning of a current conductor to one of the electrodes of the lamp. A furter increase of the distance only results in a small increase of the cooling effect.

A wall thickness of between 0.6 mm and 1.4 mm appears to be advantageous for realizing an optimum temperature distribution across the wall of the discharge vessel. A wall thickness of less than 0.6 mn has the drawback that the temperature of the wall of the discharge vessel will become unacceptably high so that the lifetime of the lamp is influenced detrimentally. Generally, a strong temperature gradient which is unwanted for a desired lifetime of the lamp will also occur across the wall of the discharge vessel. An increase of the wall thickness above 1.4 mm leads to a strong decease of the specific luminous flux.

A suitable temperature gradient across the wall of the discharge vessel is achieved in a preferred embodiment of the lamp according to the invention when the cylindrical part with an internal diameter ID extends between end faces at a mutual distance of at least 2*EA. In a further embodiment, the discharge space enclosed by the discharge vessel is sealed at the area of the end faces.

Preferably, such a value of the coldest spot temperature $T_{kp}$ is realized that the value for $\Delta\lambda$. ranges between 10 nm and 30 nm.

These and other aspects of the invention are apparent from and will be elucidated with reference to the embodiments described hereinafter.

DETAILED DESCRIPTION OF THE PREFERRED EMBODIMENTS

Figure 1:
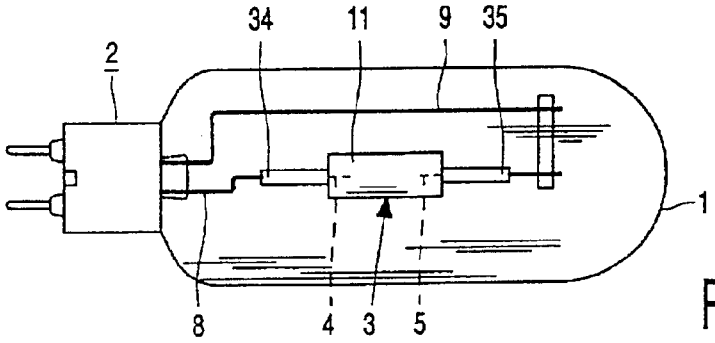
FIG. 1 shows a lamp according to the invention.
Figure 2:
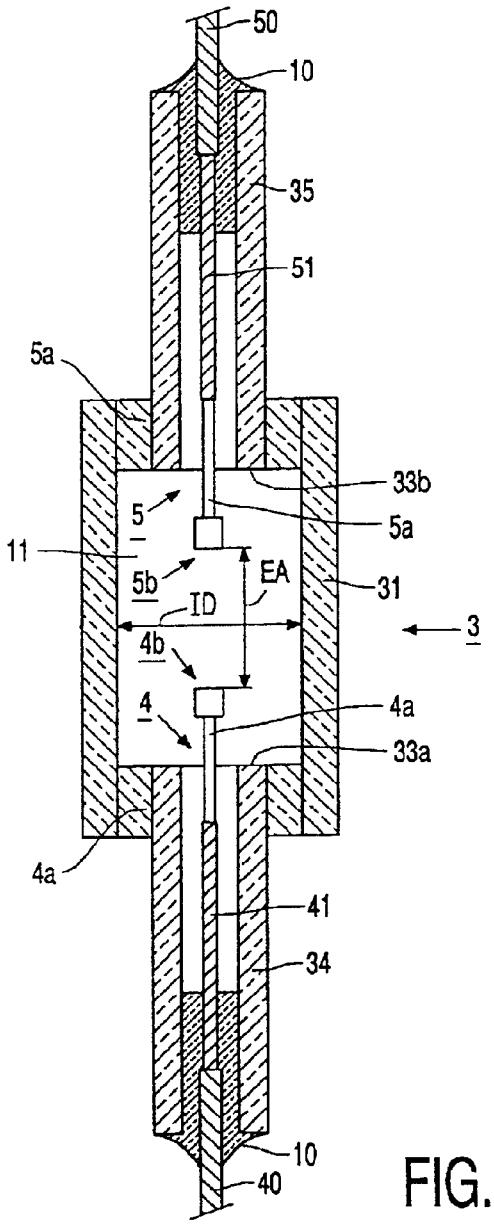
FIG. 2 is a cross-section of a discharge vessel of the lamp shown in FIG. 1.

FIG. 1 shows a metal halide lamp comprising a discharge vessel 3 shown not to scale in a cross-section in FIG. 2, which vessel has a ceramic wall enclosing a discharge space 11 which contains an ionizable filling comprising, in addition to Hg in the case shown, a quantity of iodide of Na, Tl, Ho and Ca Two electrodes 4, 5, each of W in the drawing, are arranged in the discharge space, with electrode bars 4*a*, 5*a* and with an electrode tip 4*b*, 5*b* each, located at a mutual distance EA. The discharge vessel comprises a cylindrical part having an internal diameter ID and extending between end faces 33*a*, 33*b* and at least through the distance EA. The discharge space enclosed by the discharge vessel is sealed at the area of the end faces 33*a*, 33*b*.

The discharge vessel is sealed at one end by ceramic projections 34, 35 which extend as far as the end faces 33*a*, 33*b* and narrowly enclose, with an interspace, current lead-through conductors 40, 41 and 50, 51 connected to the electrodes 4, 5 arranged in the discharge vessel, and connected thereto in a gastight manner by means of a melt-ceramic compound 10 proximate to an end remote from the discharge space. The discharge vessel is enclosed by an outer envelope 1 provided at one end with a lamp base 2. In operation, a discharge extends between electrodes 4, 5. Electrode 4 is connected via a current conductor 8 to a first electric contact which forms part of the lamp base 2. Electrode 5 is connected via a current conductor 9 to a second electric contact which forms part of the lamp base 2.

A practical embodiment of the lamp described above has a nominal power of 150 W. The electrode distance EA is 6 mm, the distance between the end faces 33*a*, 33*b* is 14 mm and the internal diameter ID is 6.85 mm. The ratio EA/ID has the value of 0.86, which complies with the EA/ID<1 measure according to the invention. The ceramic wall of the discharge vessel has a thickness of 0.8 mm. In operation, the lamp has a wall load of 116 W/cm$^2$. In addition to Hg, the ionizable filling of the discharge vessel with a pressure of 32 bar in the operating condition comprises 8.5 mg of iodide salt of NaI, TlI, $HoI_3$ and $CaI_2$ with percentages by weight of 55, 13.5, 16.5 and 15, respectively. In operation, the lamp has a lamp voltage of between 90 V and 95 V. In operation, the lamp emits light at a specific luminous flux of 89 lm/W, a color temperature $T_c$ of 3000 K and a general color rendering index value $R_a$ of 92. The value for the coldest spot temperature $T_{kp}$ and for $\Delta\lambda$.. is 1220 K and 20 nm, respectively.

For use as a light source for an optical fiber, the lamp is placed in an ellipsoid reflector having a focal length f of 18.8 mm and an aperture diameter of 83.9 mm, and is provided with a dichroic coating having a reflection coefficient of at least 0.9 for the wavelength range between 400 nm and 650 nm The optical fiber has a diameter of 15 mm. In these circumstances, the coupling efficiency is 22.5% and the specific luminous flux of the system is 19.5 lm/W.

In another practical embodiment of the lamp according to the invention, the discharge vessel has an identical construction The ionizable filling comprises Hg with a filling pressure of 24 bar in the operating condition and 8.5 mg of iodide salt consisting of NaI, TlI, $DyI_3$, $HoI_3$, $TmI_3$ and $CaI_2$ with 13.7, 8.6, 11.7, 11.7, 11.7 and 42.6% by weight, respectively. The lamp has a specific luminous flux of 88 lm/W, a color temperature $T_c$ of 4000 K and a general color rendering index value $R_a$ of 94. In operation the lamp has a voltage of 109V, whilst the value for the coldest spot temperature $T_{kp}$ 1299 k is and for $\Delta\lambda$ 12.5 nm.

What is claimed is:

1. A metal halide lamp, comprising:

a discharge vessel including a cylindrical ceramic wall defining a discharge space having an inner diameter ID;

an ionizable filling contained within said discharge space, said ionizable filling including Hg and an iodide, said iodide including Na, Tl, Ho and Ca;

a first electrode tip and a second electrode tip spatially arranged within said discharge space at a mutual distance EA, wherein the mutual distance EA is less than the inner diameter ID, and a nominal power of said lamp is greater than 100 W.

2. The metal balid lamp of claim 1, wherein the mutual distance is less than or equal to 6 mm; and wherein the inner diameter is less than or equal to 6.85 mm.

3. The meal halide lamp of claim 2, wherein said discharge vessel further includes a first end face located on a first end of said ceramic wall and a second end face located on a second end of said ceramic wall; and wherein a distance between said first end face and said second end face is less than or equal to 14 mm.

4. The metal halide lamp of claim 1, wherein said lamp has a wall load equal to or greater than 100 W/cm$^2$.

5. The metal halide lamp of claim 1, wherein said iodide further includes Dy and Tm.

6. The metal halide lamp of claim 1, further comprising:

an outer envelope spatially surrounding said discharge vessel; and an inert gas filling a space between said outer envelope and said discharge vessel.

7. The metal halide lamp of claim 6, wherein, during an operation of said lamp, a pressure range of said inert as is between 100 mbar and 1 bar.

8. The metal halide lamp of claim 6, wherein a spatial distance between said outer envelope and said discharge vessel is equal to or greater than 3 mm.

9. The metal halide lamp of claim 1, wherein said ceramic wall has a thickness equal to or greater than 0.6 mm and less than or equal to 1.4 mm.

10. The metal halide lamp of claim 1, wherein said discharge vessel further includes a first end face located on a first end of said ceramic wall and a second end face located on a second end of said ceramic wall; and wherein a distance between said first end face and said second end face is equal to or greater than twice the mutual distance EA.

* * * * *